United States Patent [19]

Yokoi

[11] Patent Number: 5,040,000

[45] Date of Patent: Aug. 13, 1991

[54] INK JET RECORDING APPARATUS HAVING A SPACE SAVING INK RECOVERY SYSTEM

[75] Inventor: Katsuyuki Yokoi, Yokohama, Japan

[73] Assignee: Canon Kabushiki Kaisha, Tokyo, Japan

[21] Appl. No.: 350,645

[22] Filed: May 11, 1989

[30] Foreign Application Priority Data

May 12, 1988 [JP] Japan ..... 63-113557

[51] Int. Cl.[5] ..... B41J 2/165

[52] U.S. Cl. ..... 346/140 R; 346/134

[58] Field of Search ..... 346/140, 75, 134

[56] References Cited

U.S. PATENT DOCUMENTS 4,207,578 6/1980 Marinoff ..... 346/75
4,266,231 5/1981 Drago ..... 346/75
4,369,456 1/1983 Cruz-Uribe ..... 346/140
4,463,359 7/1984 Ayata et al. ..... 346/1.1
4,692,778 9/1987 Yoshimura ..... 346/140 X
4,723,129 2/1988 Endo et al. ..... 346/1.1
4,893,137 1/1990 Ebinuma et al. ..... 346/140 R X

FOREIGN PATENT DOCUMENTS 115863 7/1984 Japan .

*Primary Examiner*—Joseph W. Hartary
*Attorney, Agent, or Firm*—Fitzpatrick, Cella, Harper & Scinto

[57] ABSTRACT

An ink jet recording apparatus comprises a recording head having a discharge port for discharging ink as a droplet, a head recovery device provided at a position opposed to the discharge port of the recording head, and a conveying belt driven for conveying a recording medium onto which recording is performed by discharging ink from the recording head. The conveying belt is located between the recording head and the head recovery device, which are located opposite to each other, and has an opening at a part thereof.

24 Claims, 12 Drawing Sheets

INK JET RECORDING APPARATUS HAVING A SPACE SAVING INK RECOVERY SYSTEM

BACKGROUND OF THE INVENTION

1. Field of the Invention

The present invention relates to an ink jet recording apparatus, particularly an ink jet recording apparatus having a recovery device of an ink jet recording head.

2. Related Background Art

U.S. Pat. No. 4,692,778 shows one of the conventional ink jet recording apparatuses having, for example a full-line type ink jet recording head. This ink jet recording apparatus as shown in FIG. 1, comprises an ink jet recording head 1, recording medium conveying mechanism having a platen 15 provided opposite to the ink jet recording head 1 and recording medium conveying rollers 16*a* and 16*b*, a head recovery device 2 provided on the same side of the ink jet recording head 1 with respect to the recording medium conveying mechanism and a controller 17.

In such an ink jet recording apparatus, during recording the recording medium is fed from the recording medium conveying roller 16*a* to the platen 15 in the direction of an arrow A as shown in FIG. 2A and recording is performed by discharging ink as droplets by utilizing thermal energy from the ink jet recording head 1 having elements for generating thermal energy utilized for discharging ink in response to a predetermined recording signal. Drawing of air bubbles generated upon application of thermal energy with respect to an ink discharge mechanism of an ink jet recording head is disclosed in U.S. Pat. No. 4,723,129 and driving for ink discharge is disclosed in U.S. Pat. No. 4,463,359. In case of unstable discharge or non-discharge of ink which can cause inferior recorded images during recording, the ink jet recording head is recovered. This recovery operation is performed by the head recovery device 2 as shown in FIGS. 2A, 2B and 2C. First, the ink jet recording head 1 disposed at a recording position is retracted in the direction of an arrow a as shown in FIG. 2A and then the head recovery device 2 is moved in the direction b as shown in FIG. 2B until it is opposite to the ink jet recording head 1. Finally the ink jet recording head 1 is moved in the direction c as shown in FIG. 2C to contact the head recovery device 2, thus performing the recovery operation.

During non-recording where a recording signal is not applied more than a predetermined time period, as similary during the recovery operation, in order to protect the ink jet recording head 1 the head recovery device 2 moves to a position opposite to the ink jet recording head 1, and contacts the ink jet recording head 1 for capping treatment.

On the other hand, in case of an ink jet recording apparatus in which the recording medium is conveyed by a conveying belt and recording is performed by the full-line type recording head in which discharge ports are arranged over a recordable area of the recording medium and in a direction across the conveying direction of the recording medium, the recovery operation and capping operation have been performed by a method similar to the above mentioned method.

However, when the recording head is recovered in the above stated conventional apparatus, both the ink jet recording head and the recovery device have to move complicatedly as shown in FIGS. 2A to 2C. Accordingly there are problems such as that a long time is required to recover the recording head, that complicated and highly accurate constitution is required to perform recovery and a large space for providing the recording head and the head recovery device and a large space in which both the head and the recovery device can move upon a recovery operation is required.

In addition, since the recovery operation is complicated, it is difficult to perform a delicate recovery operation such as ink discharge of a few pulses in order to prevent nozzles unused for a predetermined time period during recording from clogging caused by evaporation of ink solvent and from poor record such as dot breakage.

Furthermore, it costs high to constitute the mechanism for complicatedly and accurately moving both the ink jet recording head and the recovery device.

SUMMARY OF THE INVENTION

It is a main object of the invention to provide a compact ink jet recording apparatus in which a space for providing the ink jet recording head and the head recovery device is greatly decreased by utilizing a space in the conveying belt and no specific space is required to move the head and the recovery device upon recovery operation.

It is a further object of the invention to provide an ink jet recording apparatus of high reliability in which a complicated and precise arrangement for head recovery is not required.

DESCRIPTION OF THE PREFERRED EMBODIMENTS

The embodiments according to the present invention will be illustrated hereinafter in detail with reference to the accompanied drawings.

Figure 1:
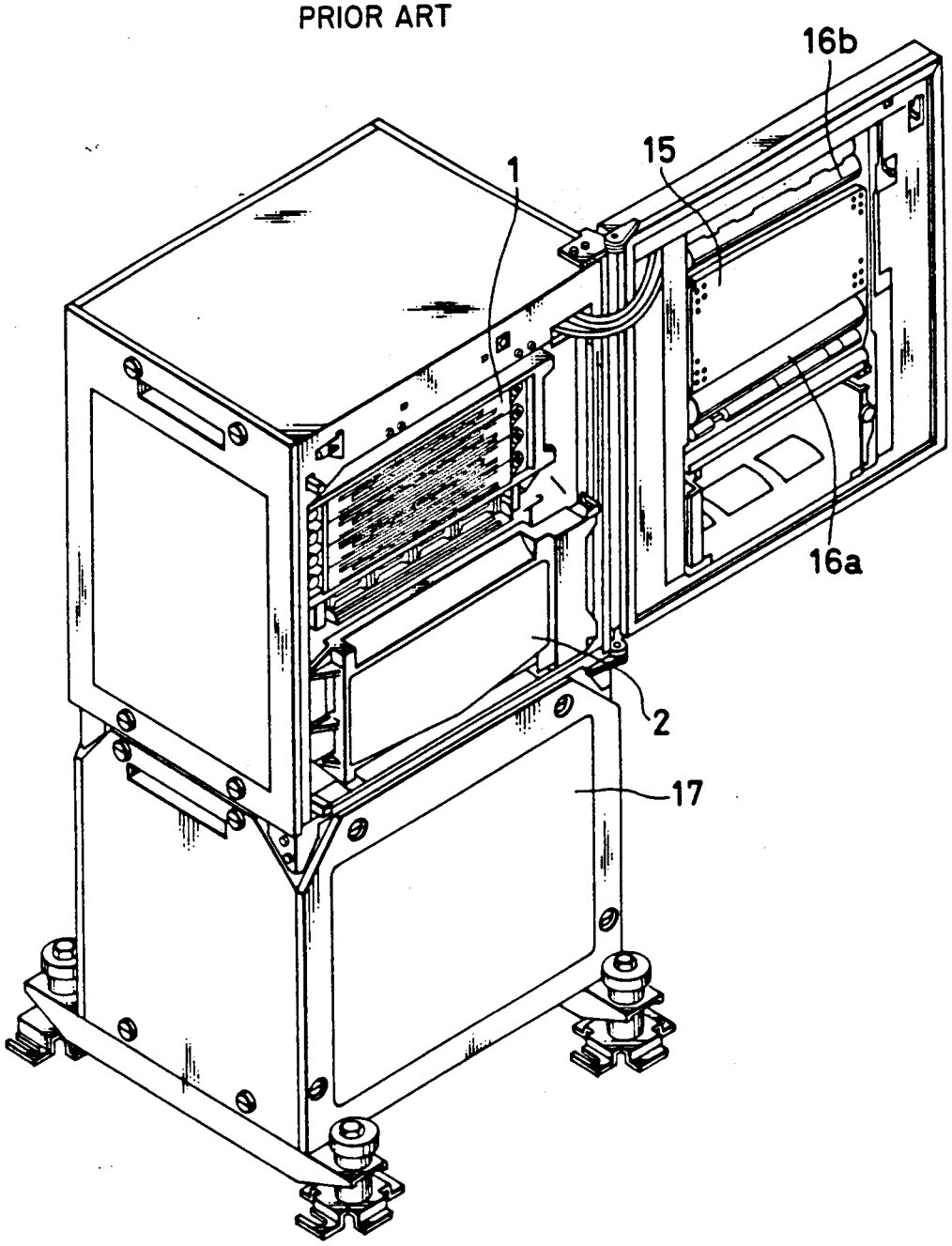
FIG. 1 PRIOR ART
FIG. 1 shows a schematic perspective view of a conventional ink jet recording apparatus.
Figure 2A:
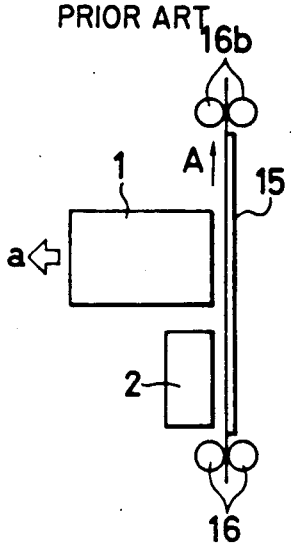
FIG. 2A PRIOR ART
FIGS. 2A, 2B and 2C show side views of the outline of a discharge recovery process and capping process in the apparatus as illustrated in FIG. 1.
Figure 2B:
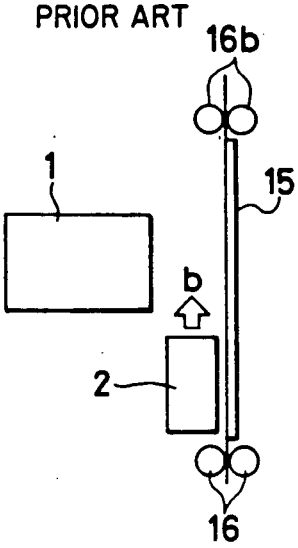
FIG. 2B PRIOR ART
Figure 2C:
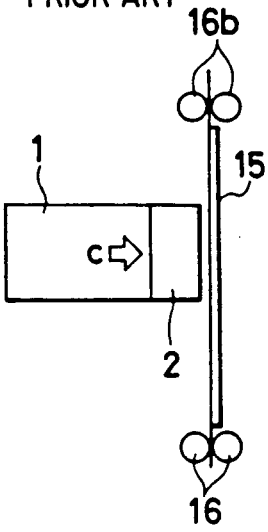
FIG. 2C PRIOR ART
Figure 3:
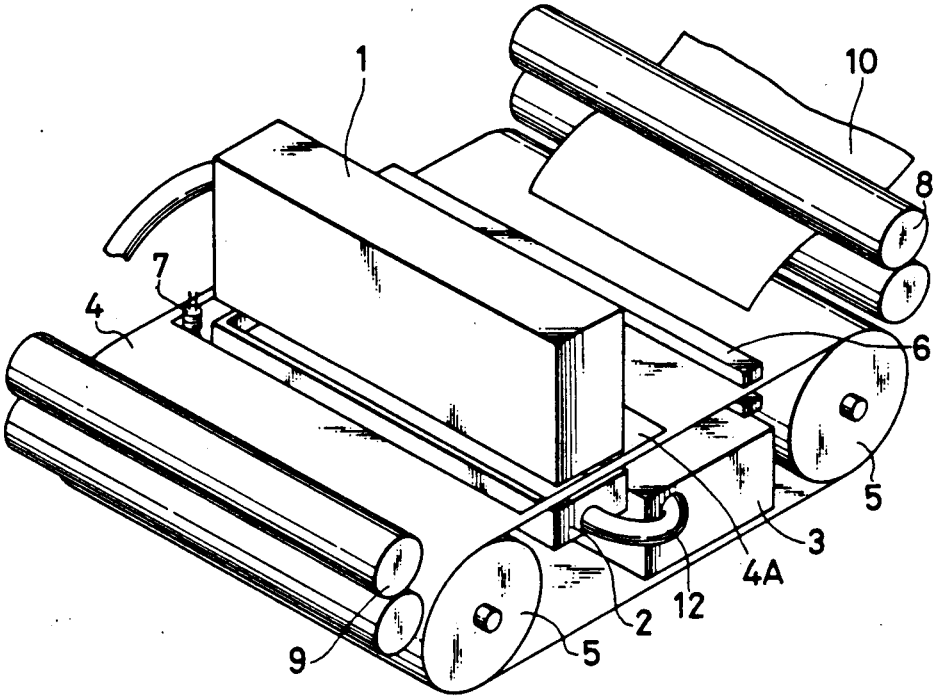
FIG. 3 shows a schematic perspective view of a main portion of an ink jet recording apparatus according to an embodiment of the present invention.

FIG. 3 shows a schematic perspective view of a main portion of an ink jet recording apparatus according to an embodiment of the present invention. In FIG. 3, a full-line type ink jet recording head 1 has elements (not shown) for generating thermal energy utilized for discharging ink droplets from a discharge port (not shown) and in which discharge ports are arranged over a recordable area of the recording medium and in a direction across the conveying direction of the recording medium. A head recovery device 2 is disposed opposite to the recording head 1 and provided by utilizing a space area in the conveying belt 4 through the conveying belt 4. A waste ink tank 3 is disposed downstream of a conveyance route of a recording medium 10 to contain ink consumed by the head recovery process. A recording medium conveying belt 4 has an opening 4A through which the discharge port surface of the ink jet recording head can pass. A conveying belt feeding roller 5 moves the conveying belt 4. A static electricity generating device 6 generates static electric energy for absorbing the recording medium 10 to the conveying belt 4. A detecting sensor 7 detects through the opening 4A of the conveying belt 4 that the recording head 1 is opposed to the recovery device 2. A paper feed roller 8 feeds the recording medium 10 onto the conveying belt 4. An exhausting roller 9 exhausts the recording medium 10.

Figure 4:
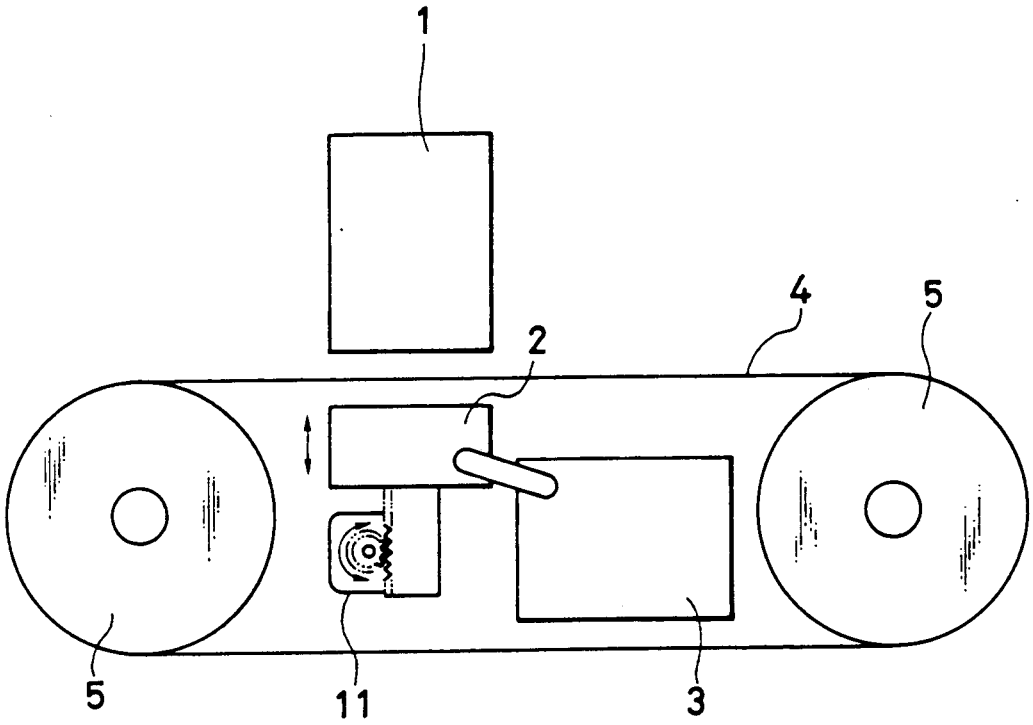
FIG. 4 shows a schematic side view of a main portion of an ink jet recording apparatus according to an embodiment of the present invention.

FIG. 4 shows side view of the apparatus as shown in FIG. 3. As shown in FIG. 4, the head recovery device 2 is moved upward and downward by a driving motor 11 for moving the recovery device 2 which is provided at the lower side of the recovery device 2.

A specific space for providing the head recovery device 2 is not required in the apparatus since the head recovery device 2 is provided in the space of the conveying belt.

Figure 10:
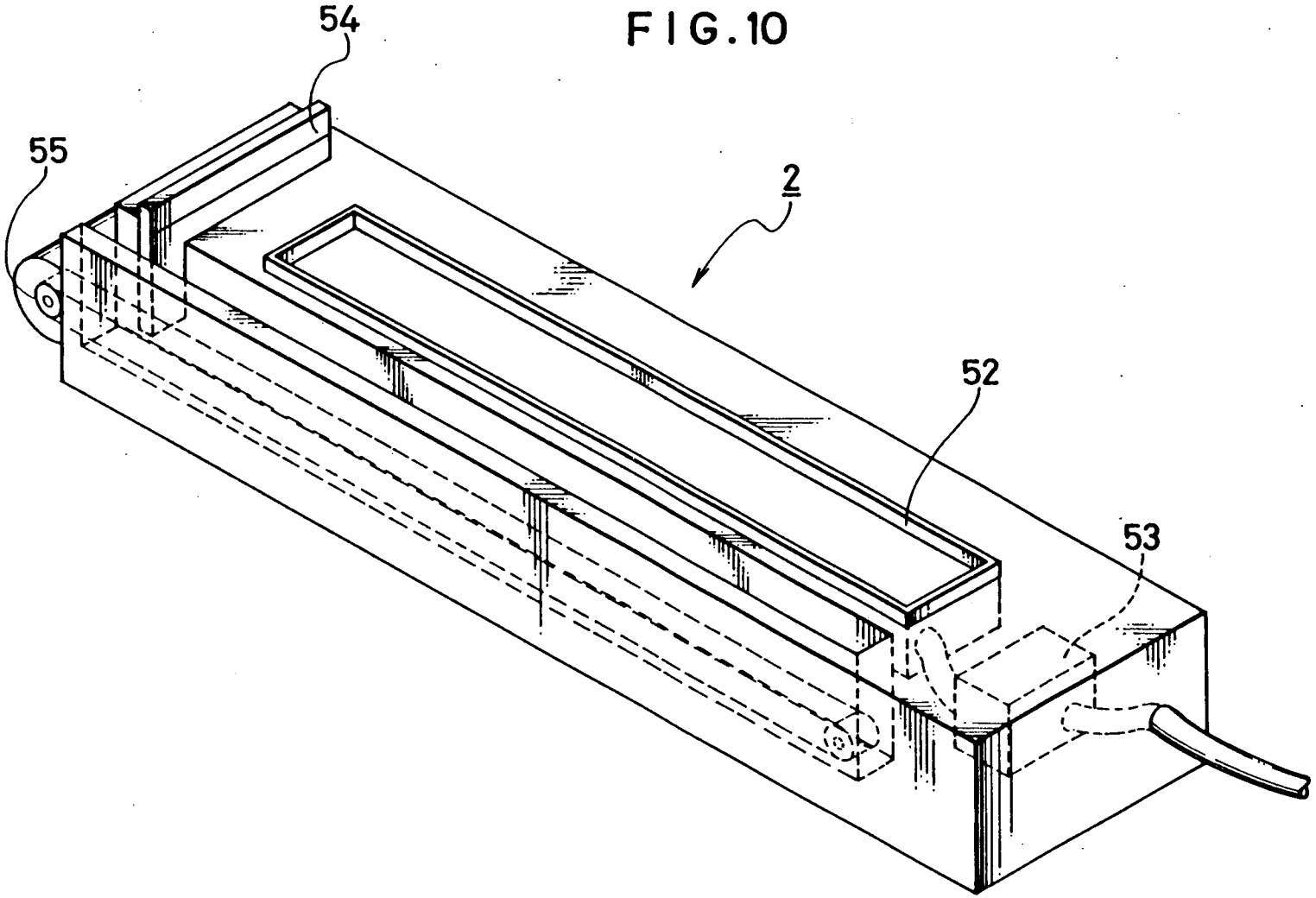
FIG. 10 is a schematic perspective view showing another embodiment of the head recovery device.

In addition, the head recovery device 2 of the ink jet recording apparatus may have an arrangement as shown in FIG. 10.

This arrangement comprises a cap member 52 for suction recovery, a suction pump 53 for sucking, a cleaning member 54 for cleaning a discharge surface of the recording head and a driving member 55 for driving the cleaning member 54. Owing to this arrangement, the discharge surface of the recording head 1 is cleaned by the cleaning member 54 so that the discharge surface can be prevented from being wet by ink and ink mist which causes unstable discharge or poor discharge of ink. Slits may be provided at a leading edge of the cleaning member 54 and by these slits cleaned ink is separated from the leading edge of the cleaning member 54 by capillary force.

An absorbing member may also be provided on a surface of the head recovery device 2 facing the recording head 1 as shown in FIG. 3 and in the cap member 52 of the head recovery device 2 as shown in FIG. 10. Ink discharged to the head recovery device 2 is prevented from splashing back, thus the interior of the apparatus and the conveying belt 4 can be prevented from being polluted by ink mist and other debris.

The cleaning member 54 of the head recovery device 2 as shown in FIG. 10 may be constituted by an elastic material. The cleaning member 54 can clean the recording head 1 in a one way direction or in a reciprocal direction. Another cleaning means may also be provided for removing ink deposited onto the cleaning member 54 after cleaning. This cleaning means may be, for example an absorbing member for absorbing ink deposited onto the cleaning member 54 so that ink is effectively removed. Also other means may be provided to achieve the above mentioned objects.

Figure 5:
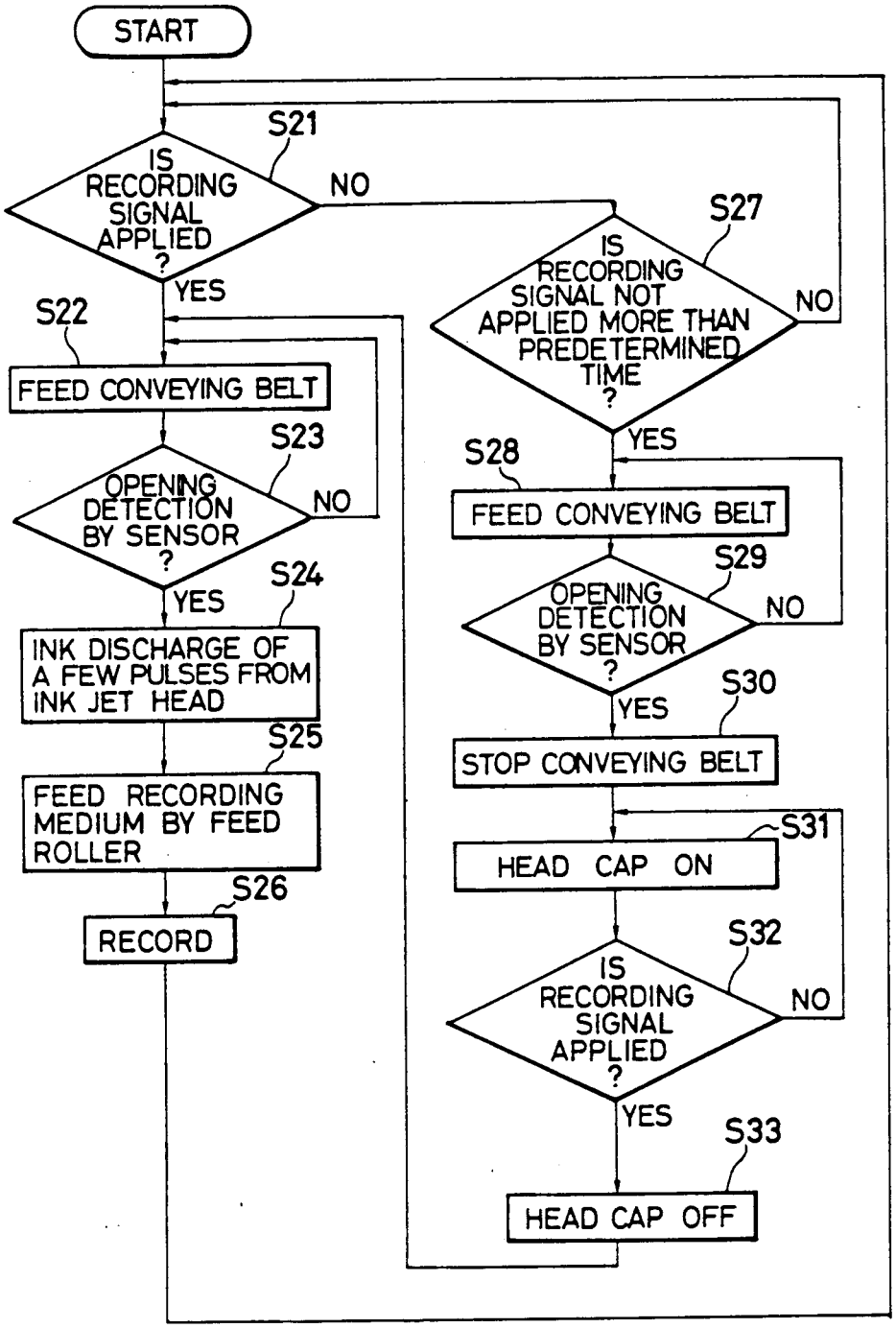
FIG. 5 is a flowchart showing the discharge recovery process and capping process in the embodiment.

The discharge recovery process and capping process in response to the above described arrangement will be explained with reference to the flowchart as shown in FIG. 5.

During recording operation, it is decided whether a recording signal is applied or not at a step S21 and, if the recording signal is applied, the conveying belt 4 starts to feed at a step S22. When the conveying belt 4 is fed by the conveying belt feed roller 5, the sensor 7 detects, at a step S23, that the opening 4A of the conveying belt 4 is located at a predetermined position. Further, when it is detected through the opening 4A that the ink jet recording head 1 is opposed to the head recovery device 2, at a step 24 a signal is applied to the ink jet recording head 1 as an operation for recovering non-discharge caused by evaporation of ink solvent when the nozzles are not used for a long time. Then ink by a few pulses is discharged and discharged ink droplets are collected in the head recovery device 2 through a pipe as shown in FIG. 3. Simultaneously with this ink discharge, the recording medium 10 is fed by the feed roller 8 to the conveying belt 4 at a step S25. The recording medium 10 is absorbed on and conveyed by the conveying belt 4 by means of static electrical energy generated by the static electricity generating device 6, thus recording being performed by the ink jet recording head 1 at a step S26. Accordingly, the recording medium 10 is conveyed only at an area except the area on which the opening 4A of the conveying belt 4 is formed.

When no recording signal is applied at the step 21, the sequence advances to a step S27. At the step S27, when it is determined that the recording signal is not applied for a predetermined time, at a step S28 the conveying belt 4 is fed until the opening 4A is detected to be located at the predetermined position. When the opening 4A is detected at a step S29, the conveying belt 4 is stopped at a step S30. At a step S31, the head recovery device 2 is driven by the driving motor 11 as shown in FIG. 4 and moves to the ink jet recording head 1 which is fixedly provided to cap the surface of the discharge port of the ink jet recording head 1. Next, when the recording signal is detected to be applied to at a step S32, the head recovery device 2 is driven by the driving motor 11 and returns to a predetermined position at a step S33. Then a succeeding recording operation after the step S22 is performed. It should be noted that in the capping process ink may be discharged for recovery just after capping.

Figure 6:
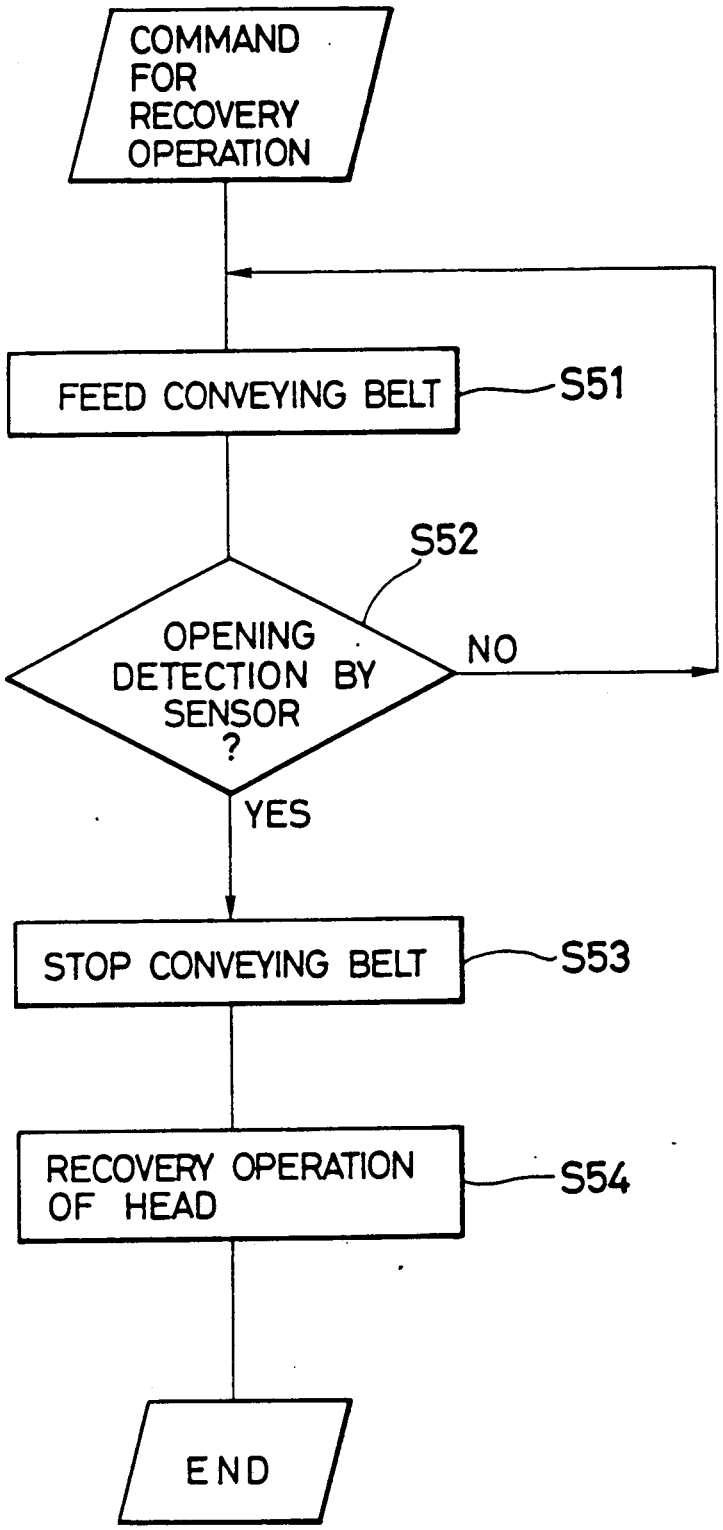
FIG. 6 is a flowchart showing the discharge recovery process in the embodiment.

The recovery process when recording errors occur will be described with reference to a flowchart of FIG. 6.

When a command signal for recovery operation is generated, the conveying belt 4 is fed by the conveying belt feed roller 5 at a step S51. When the opening 4A of the conveying belt 4 is detected by the sensor 7 at a step S52, the conveying belt 4 is stopped at a step S53. Then the head recovery device 2 moves to the ink jet recording head 1 at a step S54 and head recovery is performed. The head recovery device 2 returns to a predetermined position for usual recording operation when the head recovery operation is terminated.

The recovery operation performed in the above illustrated step of capping and the step of recovery treatment is terminated upon ink suction of the recording head 1 by the suction pump (not shown) constituting the head recovery device 2 and ink discharge by a few pulses from the recording head 1 after covering the discharge port by the head recovery device 2.

Figure 11:
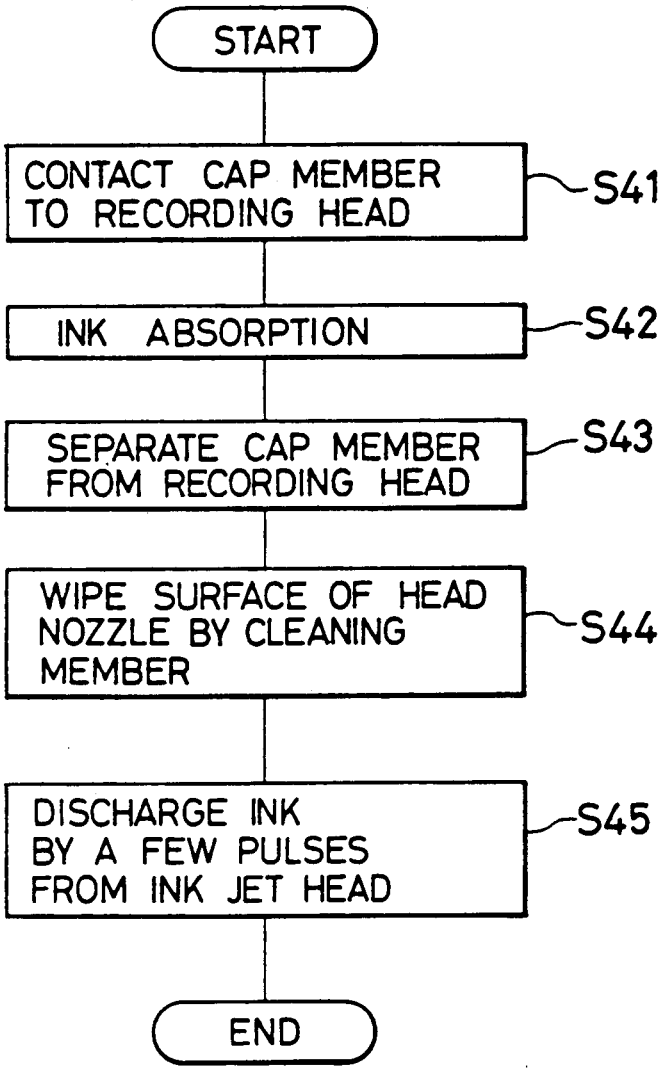
FIG. 11 is a flow chart of a recovery operation.

Additionally, for example in the head recovery device 2 having a blade as the cleaning means for cleaning the discharge surface of the recording head 1 as shown in FIG. 10, the cap member 51 of the head recovery device 2 is moved to the recording head 1 and is in contact with it at a step S41 as shown in FIG. 11. Then at a step S42, ink on the recording head 1 is absorbed. Next at a step S43, the cap member 51 is separated from the recording head 1 and at a step S44, the cleaning member 54 cleans the discharge surface of the recording head 1. After cleaning, at a step S45 ink by a predetermined pulse is discharged from the recording head 1, thus terminating recovery operation.

In case of the above mentioned recovery operation, in the apparatus according to the invention it is not necessary to enlarge the space occupied by the recording head 1 and the head recovery device 2 which are available in recording. Namely, the head recovery device 2 is driven for recovery operation in an area within the space occupied by the recording head 1 and the head recovery device 2 facingly provided at a recordable state through the conveying belt. To put it briefly, a specific space is not required for the recovery operation.

As stated above, the embodiments have been illustrated in which the head recovery device 2 provided opposite to the recording head 1 through the conveying belt 4 is only moved to the recording head 1 for recovery operation.

However, the ink jet recording apparatus according to the invention is not limited to the illustrated embodiments. The recording head 1 may be facingly moved to the fixed head recovery device 2 and also both the recording head 1 and the head recovery device 2 may be facingly moved for recovery operation.

In case of either arrangement, in the recovery operation, it is not necessary to enlarge the space occupied by the recording head 1 and the head recovery device 2 which are available in recording. Namely, the head recovery device 2 is driven for recovery operation in an area within the space occupied by the recording head 1 and the head recovery device 2 facingly provided at a recordable state through the conveying belt. To put it briefly, a specific space is not required for recovery operation. Thus, the apparatus can be compact.

If the recording head 1 only moves to face to the head recovery device 2, the conveying surface of the conveying belt 4 on which the recording medium is conveyed is prevented from being polluted by ink mist possibly caused by the recovery operation since the contacting position of both recording head 1 and recovery device 2 is under the opening of the conveying belt 4.

On the other hand, if only the head recovery device 2 moves to face to the recording head 1, the positional accuracy of the recording head 1 can be maintained good since the recording head 1 is fixed.

In the invention, the recording head 1 is recovered by the head recovery device 2 provided to face to the recording head 1 through the opening formed on the conveying belt 4. In this case, the opening 4A is always opened and the recording medium is not conveyed at the opening 4A. For this purpose, the recording medium should be always conveyed at a timing when the recording medium is not located at the opening 4A of the conveying belt 4.

Figure 12A:
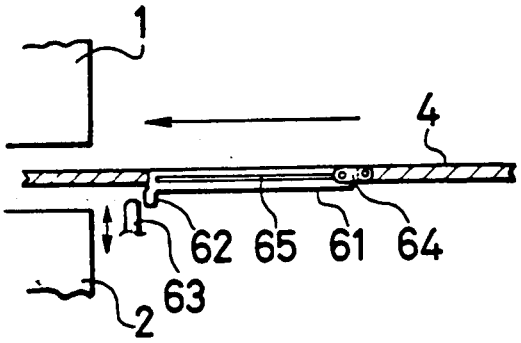
FIGS. 12A, 12B and 12C are schematic partial cross sectional views of the shutter mechanism of the conveying belt.
Figure 12B:
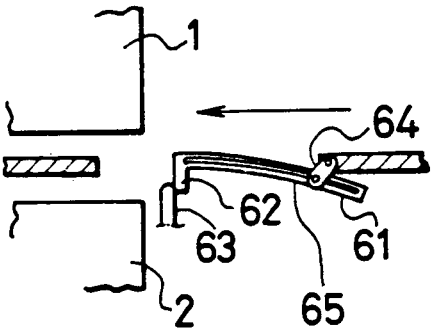
Figure 12C:
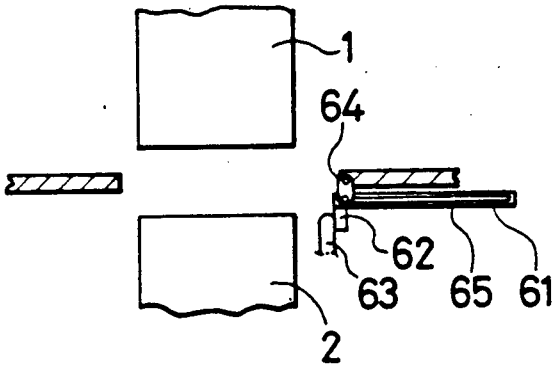

The entire conveying belt can be used for conveying the recording medium by providing a shutter at the opening 4A. Accordingly, the timing of the supply of the recording medium is controlled only when the recording head 1 is recovered and the recording speed is improved by providing the shutter at the opening of the conveying belt 4. This opening 4A has arrangements as shown in FIGS. 12A to 12C. As shown in FIG. 12A, by driving the conveying belt 4 an engaging piece 63 which is located before the conveying belt 4 and movable upward and downward to engage with an engaging portion 62 of the shutter 61 projects upward at a predetermined timing and engages with the engaging portion 62. As shown in FIG. 12B a joint member 64 jointing the conveying belt 4 and the shutter 61 slides in a groove provided on the side of the shutter 61 as the conveying belt 4 moves and the shutter member 61 moves under the conveying belt 4. Then when the opening is fully opened as shown in FIG. 12C, the recording head 1 opposes the head recovery device 2. Fully opened shutter member 61 closes the opening 4A by a restoring force of a spring and other (not shown) when the engaging piece 63 retracts downward and is released from engagement with the engaging portion 62.

A cover member may be provided on the contacting surface of the head recovery device 2 to the recording head 1. By providing the cover member, foreign materials floating in the apparatus by wind generated by rotation of the conveying belt during recording is prevented from depositing on the contacting surface of the head recovery device 2.

In this invention, a detecting sensor detects that the opening provided on the conveying belt is located between the recording head and the recovery means so that the opening of the conveying belt can be easily and surely defined.

The sensor may be for example, a reflect type photosensor and a photo-interruptor and other suitable means capable of detecting the opening may be also used. For instance, the conveying belt feed roller is driven by a pulse motor and the pulse may be counted if the relationship between the conveying belt feed roller and the opening of the conveying belt is definitely predefined.

It should be noted that the location of the opening can be more easily and surely detected when the reflect type photosensor or the photo-interruptor is used.

In this apparatus, it is important to maintain the distance between the surface of the discharge port of the ink jet recording head 1 and the conveying belt 4 constant in view of maintaining recording quality. For this purpose the conveying belt 4 and the conveying belt feed roller 5 should be adequately arranged.

Figure 7:
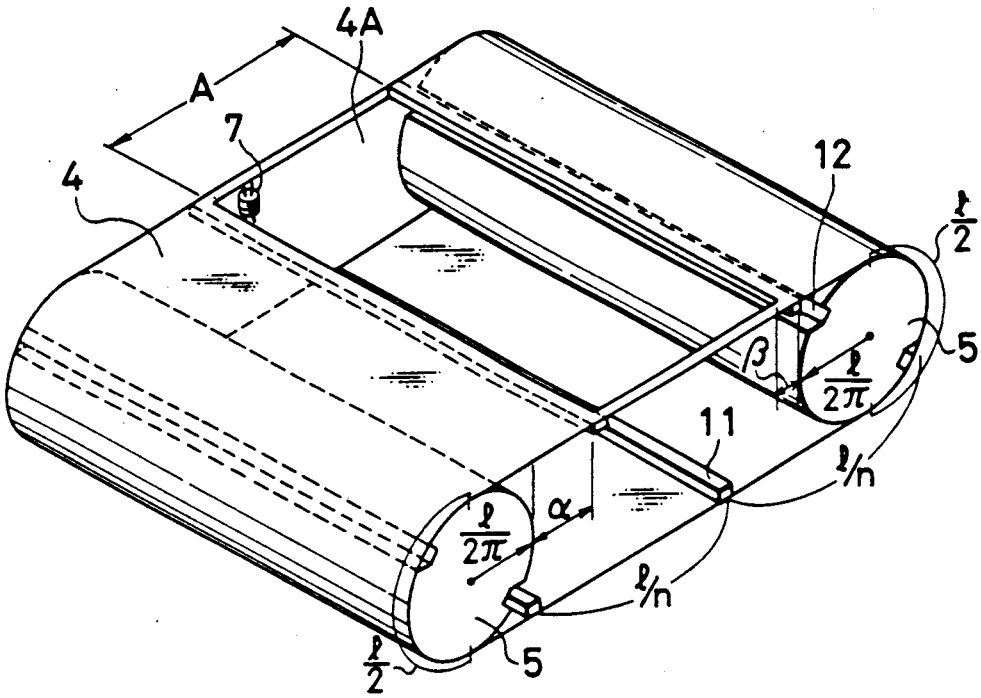
FIGS. 7, 8 and 9 show perspective views illustrating an example of the conveying belt and the belt feed roller.

FIG. 7 shows a preferred embodiment of this arrangement. In FIG. 7 a reference numeral 5 denotes a conveying belt feed roller; 4 denotes a conveying belt 4 having an opening 4A; 11 denotes a support member provided on a predetermined location of the conveying belt 4; and 12 denotes a groove provided around the conveying belt feed roller 5. The support member 11 provided on the conveying belt 4 prevents surrounding portions of the opening 4A of the conveying belt 4 from contacting the ink jet recording head because of distortion effected by tension when the conveying belt 4 is fed.

It is preferable to satisfy the relation as defined in the following equation, $$L=(l/n)m \quad (1),$$

where the circumference of the conveying belt feed roller 5 is l and the length of the conveying belt 4 is L and where m and n are natural numbers.

Regarding m and n, it is preferable to satisfy the relation as defined in the following equation, $$\frac{m}{n} > \frac{2}{\pi} + \frac{2A}{l} + 1 \quad (2)$$

The equation (2) will be illustrated hereinafter with reference to FIG. 7. In FIG. 7, A shows the maximum gap between rod members disposed between two conveying belt feed roller 5 and $\alpha$ and $\beta$ show the distances between the rod members and the conveying belt feed roller 5.

Then the length L of the conveying belt 4 is shown by the following equation,, $$L = \frac{l}{2} \times 2 + \left( \frac{l}{2\pi} + A + \frac{l}{2\pi} + \alpha + \beta \right) \times 2.$$

Since $\alpha$ and $\beta$ show the idle tolerance of the conveying belt 4, the length L of the conveying belt 4 is shown in the following equation, $$L > l + \frac{2l}{\pi} + 2A$$

$$> l\left( \frac{2}{\pi} + \frac{2A}{l} + 1 \right).$$

Since from the equation (1) the length L is as shown in, $$L = \left( \frac{l}{n} \right) \cdot m,$$

$$l \cdot \frac{m}{n} > l\left( \frac{2}{\pi} + \frac{2A}{l} + 1 \right).$$

Thus, $$\frac{m}{n} > \frac{2}{\pi} + \frac{2A}{l} + 1. \quad (2)$$

The conveying belt 4 having such relationship comprises a belt member and the rod like support members 11 having the above mentioned functions, which is provided at each l/n in the feeding direction and is perpendicular to the feeding direction. A hole is provided between the adjacent support members. The hole has the length of l/n in the feeding direction and the surface of the discharge port of the ink jet recording head 1 can pass through the hole. Additionally, corresponding to this arrangement the groove 12 is formed on the conveying belt feed roller 5 at each distance of l/n. The groove 12 engages with the support member 11 of the conveying belt 4.

Figure 8:
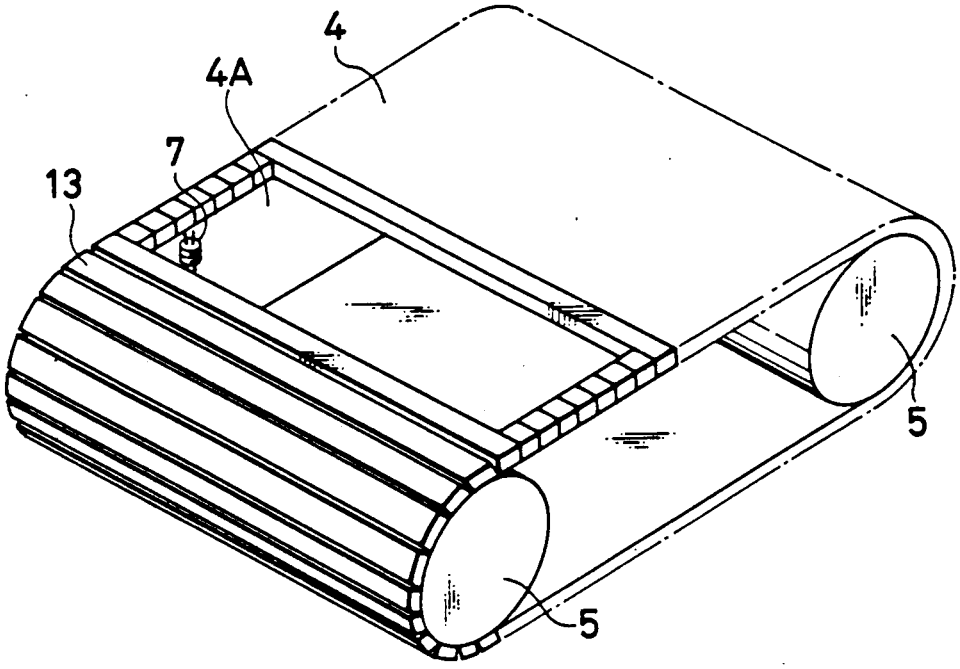

FIG. 8 shows another embodiment of the conveying belt. In this embodiment, the conveying belt 4 is formed by connecting a plurality of rod like members 13 to be adjacent each other and perpendicularly to the feeding direction of the recording medium with a wire or vulcanization. Since the conveying belt 4 is formed by the rod like members 13, it is prevented to effect the distortion on the conveying belt 4 even by the tension applied to the belt during conveyance. The distance between the discharge surface of ink jet recording head 1 and the conveying belt 4 can be maintained constant.

It should be noted that the detecting sensor for detecting the opening is provided in both embodiments.

Figure 9:
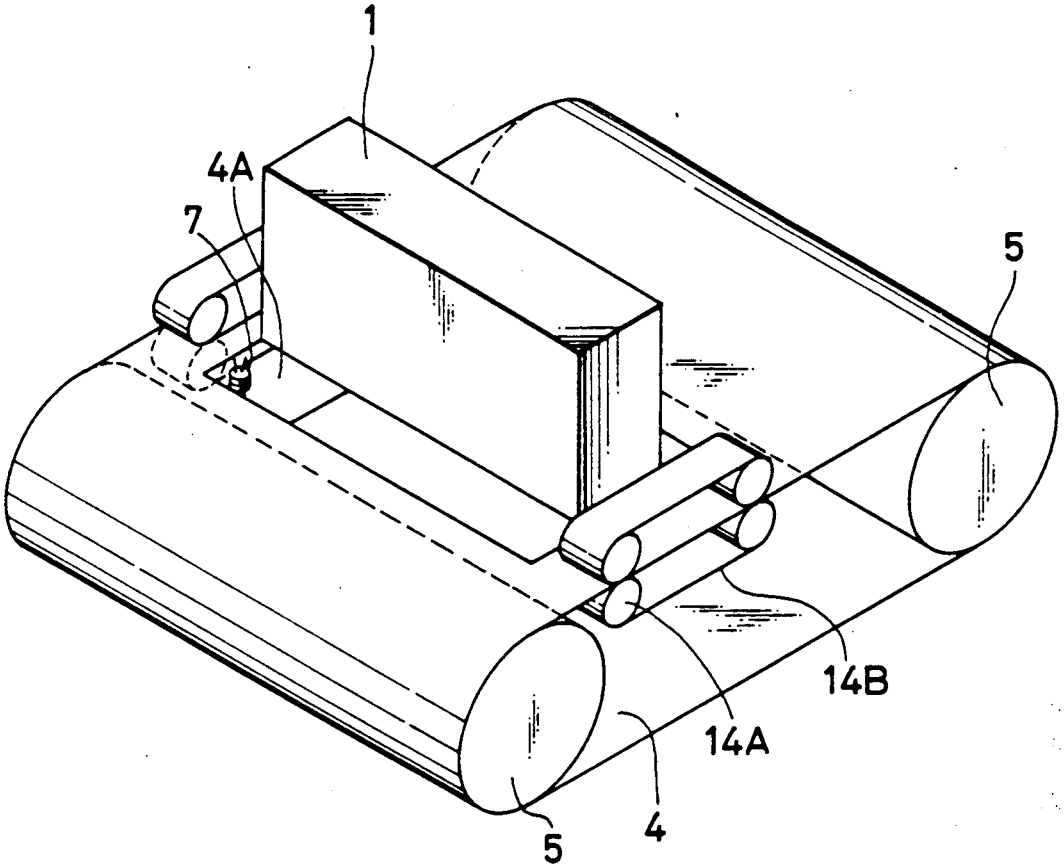

FIG. 9 shows an embodiment of a recording medium feeding mechanism comprising the conveying belt 4 and the conveying belt feed roller 5. An assisting roller 14A and an assisting belt 14B which control the conveying belt 4 is provided in the vicinity of the ink jet recording head 1 in such a manner that the distance between the discharge port surface and the conveying belt 4 is maintained always constant. According to this arrangement, the distance between the discharge port surface and the conveying belt 4 may be maintained always constant.

Owing to the arrangement as shown in FIGS. 7 to 9, the distance between the discharge port surface and the conveying belt 4 or the recording medium 10 may be maintained always constant. Accordingly, the size and the location of ink dots formed by the ink jetting can be accurate and precise recording may be performed.

In the above mentioned, the embodiment having a single ink jet recording head 1 of full-line type has been described. However, the present invention is not limited to this embodiment. The present invention can also be applied to an apparatus of the recording medium conveying belt type, which has a plurality of ink jet recording heads of full line type and can perform color recording and an apparatus of recording medium conveying belt type, which has a ink jet recording head of serial type and can perform color recording.

Figure 13:
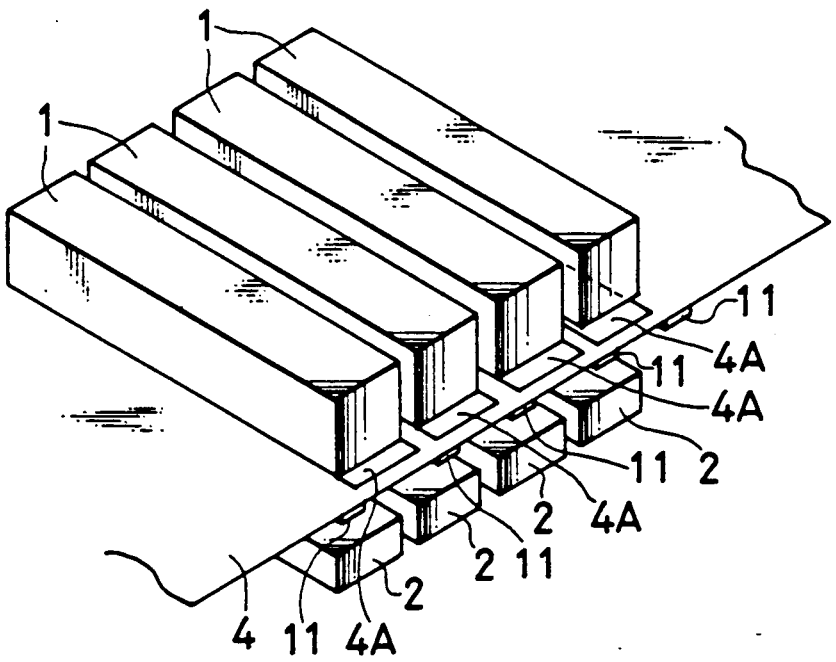
FIG. 13 is a schematic perspective view showing another embodiment of the head recovery device applied to a full line type recording head.

In the apparatus having a full-line color recording head, as shown in FIG. 13, each of the recording heads is formed along with a plurality of openings in the conveying belt, respectively, thus obtaining the object of the invention. Also, in this case, detecting means such as a sensor is used to detect the position of the opening. In this case, support member 11 is provided between the formed openings to prevent the openings from deforming under the tension of the conveying belt.

Figure 14A:
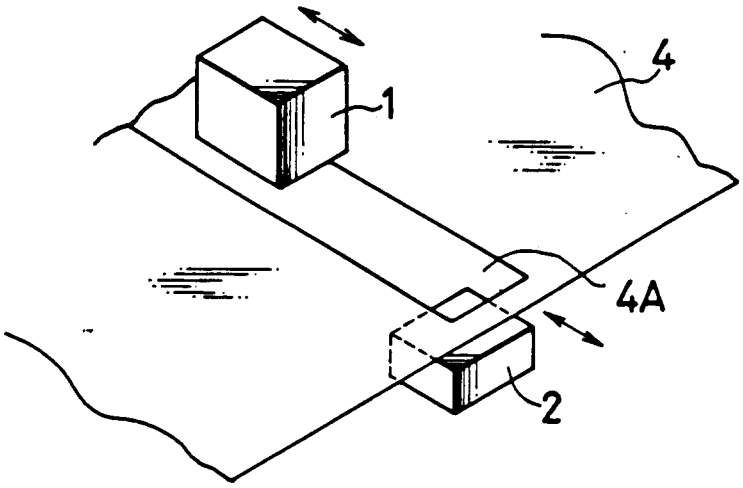
FIGS. 14A, 14B and 14C are schematic perspective views showing another embodiment of the head recovery device applied to a serial type recording head.
Figure 14B:
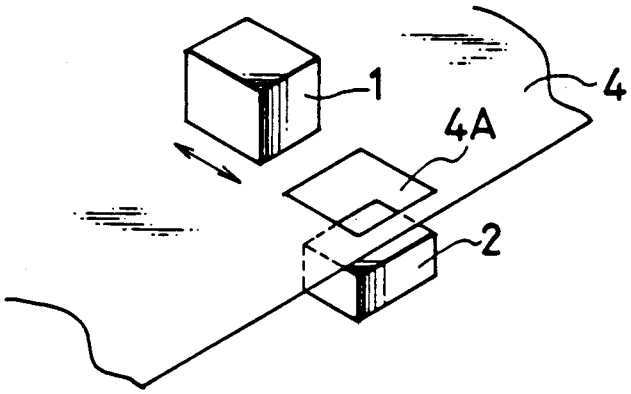

In the apparatus having a serial type recording head, as shown in FIG. 14A, the opening 4A may be formed at a part of the conveying belt 4 over the entire scanning width of the recording head 1 or at a predetermined location as shown in FIG. 14B. Further, the openings 4A may be separately provided over the entire scanning width of the recording head 1.

Figure 14C:
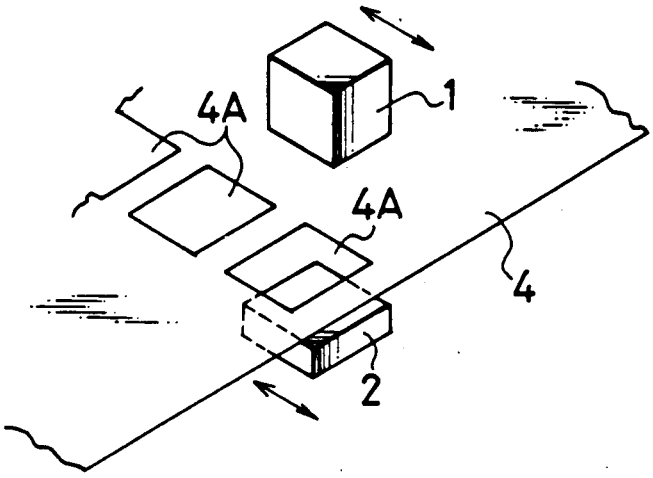

Though the opening 4A may be provided at any position of the conveying belt 4 in FIG. 14B, it is preferable that the opening 4A is positioned in the vicinity of the center of the conveying belt 4 so that the recording head 1 can move to the recovery device within minimum moving range regardless of the position of the recording head 1. In FIG. 14C, the tension in the width direction of the conveying belt 4 is equalized to obtain stable conveyance. It is needless to say that the recovery device 2 also moves upon scanning of the recording head 1 at the recovery operation in FIGS. 14A and 14C.

As described above, the head recovery means is provided in a space in the conveying belt so that specific space for the head recovery means is not necessary.

Additionally, since the recovery operation can be performed in the space occupied by the recording head 1 and the recovery device 2 which are located opposite to each other through the conveying belt 4 at the recordable state, no specific space is required. Thus, a very compact ink jet recording apparatus can be obtained.

For recovering the recording head 1, the recording head and/or the head recovery means can only be moved to be opposed to each other accordingly no complicated and precise arrangement is required. As a result, an ink jet recording apparatus can be provided at a low cost and high reliability.

What is claimed is:

1. An ink jet recording apparatus, comprising:

a recording head having a discharge port for discharging ink as a droplet;

head recovery means provided at a position opposite to said discharge port of said recording head, with said head recovery means including cap means for covering and receiving ink from said discharge port and suction means connected to said cap means for collecting ink from said discharge port to recover operation of said recording head in association with said cap means; and a conveying belt located between said recording head and said head recovery means and having an opening at a part thereof, with said conveying belt being driven to convey on an outer surface thereof a recording medium on which an image is formed by said recording head, wherein said opening is large enough to permit said recording head to contact said cap means through said opening, said head recovery means being disposed in an area surrounded by said conveying belt, and said recording head and said cap means are relatively movable only in directions opposed to each other whereby said cap means can cover said discharge port.

2. An ink jet recording apparatus according to claim 1, further comprising:

a recording head having a discharge port for discharging ink;

head recovery means provided at a position opposed to said discharge port of said recording head;

a conveying belt driven for conveying a recording medium onto which recording is performed by discharging ink from said recording head, said conveying belt being located between said recording head and said head recovery means which are located opposite to each other and having an opening at a part;

detecting means for detecting that said opening section of said conveying belt is positioned between said recording head and said cap means, wherein a recovery operation performed by said recovery means recovers ink from said discharge port only when said detecting means detects that said opening of said conveying belt is positioned between said recording head and said cap means.

3. An ink jet recording apparatus according to claim 2, wherein said recovery operation includes an operation for discharging ink from said recording head through said opening of said conveying belt when said recording head is spaced apart from said head cap means.

4. An ink jet recording apparatus according to claim 2, wherein said recovery operation includes an operation for discharging ink from said recording head through said opening of said conveying belt when said recording head is in contact with said cap means.

5. An ink jet recording apparatus according to claim 2, wherein a capping operation for maintaining a state that said recording head is in contact with said cap means is performed only when said detecting means detects that said opening of said conveying belt is located between said recording head and said cap means.

6. An ink jet recording apparatus according to claim 5, wherein a recording operation starts after said capping operation and said conveying belt is driven to convey the recording medium to a recording area, and wherein the recording medium is conveyed by said conveying belt to an area different from where said opening in said conveying belt is formed.

7. An ink jet recording apparatus according to claim 2, wherein a recording operation starts after said recovery operation and said conveying belt is driven to convey the recording medium to a recording area, and wherein the recording medium is conveyed by said conveying belt to an area different from where said opening in said conveying belt is formed.

8. An ink jet recording apparatus according to claim 2, wherein said head recovery means has a cleaning member capable of cleaning a surface on which said discharge port of said recording head is provided.

9. An ink jet recording apparatus according to claim 8, wherein recovery operation performed by said head recovery means includes a cleaning operation for cleaning a surface on which said discharge port of said recording head is provided.

10. An ink jet recording apparatus according to claim 1, wherein said head recovery means has a cleaning member capable of cleaning a surface on which said discharge port of said recording head is provided.

11. An ink jet recording apparatus according to claim 1, wherein said head recovery means has a cleaning member capable of cleaning a surface on which said discharge port of said recording head is provided, and an absorbing member capable of absorbing ink at a position opposite to said surface on which said discharge port of said recording head is provided.

12. An ink jet recording apparatus according to claim 1, further comprising detecting means for detecting that said opening in said conveying belt is located between said recording head and said cap means.

13. An ink jet recording apparatus according to claim 1, wherein said cap means is fixedly provided and said recording head moves downwardly from a recordable position to contact said cap means.

14. An ink jet recording apparatus according to claim 1, wherein said cap means is movable with respect to said recording head, and said recording head moves downwardly from a recordable position to contact said cap means.

15. An ink jet recording apparatus according to claim 1, wherein said recording head is of a full-line type and said discharge port is provided along the entire width of a recording area of the recording medium.

16. An ink jet recording apparatus according to claim 1, wherein said recording head is of a serial type in which an image is recorded by moving along the entire width of a recording area of the recording medium in a direction transverse to a conveying direction of the recording medium, and said opening is along the entire width in which said recording head is movable.

17. An ink jet recording apparatus according to claim 1, wherein said recording head is of a serial type in which an image is recorded by moving along the entire width of a recording area of said recording medium in a direction transverse to a conveying direction of the recording medium, and one or more openings is provided in said conveying belt, with said openings having substantially the same area as a discharge port forming surface of said recording head.

18. An ink jet recording apparatus comprising:

a recording head having a discharge port for discharging ink as a droplet;

head recovery means provided at a position opposite to said discharge port of said recording head; and a conveying belt provided between said recording head and said recovery means and being driven by a pair of feed rollers, said conveying belt having an opening through which said recording head can contact said head recovery means, with said conveying belt conveying a recording medium on which an image is formed by said recording head, wherein said conveying belt satisfies an equation, $$L=(l/n)\cdot m,$$

wherein L is the length of said conveying belt, l is the circumferential length of said feed roller of said conveying belt and n and m are natural numbers, and said conveying belt has a plurality of supporting members fittable into grooves provided at each l/n in said feed rollers in a direction transverse to a feeding direction of said conveying belt, with said opening being provided between a pair of adjacent supporting members

19. An ink jet recording apparatus comprising:

a recording head having a discharge port for discharging ink as a droplet;

head recovery means provided at a position opposite to said discharge port of said recording head; and a conveying belt provided between said recording head and said recovery means, said conveying belt having an opening through which said recording head can contact said head recovery means, with said conveying belt conveying a recording medium on which an image is formed by said recording head, wherein said conveying belt is formed by joining adjacent rod-like members in a direction transverse to a feeding direction of said conveying belt, with the opening being formed by a cut-out portion in said rod-like members.

20. An ink jet recording apparatus, comprising:

a recording head having a discharge port for discharging ink as a droplet;

head recovery means provided at a position opposite to said discharge port of said recording head; and a conveying belt provided between said recording head and said recovery means, said conveying belt having an opening through which said recording head can contact said head recovery means, with said conveying belt conveying a recording medium on which an image is formed by said recording head, wherein said conveying belt has a second set of feed rollers disposed on opposite sides of a surface of said conveying belt at a position where said recording head opposes said recovery means.

21. An ink jet recording apparatus, comprising:

a recording head having a discharge port for discharging ink as a droplet;

head recovery means provided at a position opposite to said discharge port of said recording head, with said head recovery means including a cap provided for covering said discharge port and suction means connected to said cap for recovering ink from said discharge port;

a conveying belt located between said recording head and said head recovery means and having an opening at a part thereof, with said conveying belt being driven to convey on an outer surface thereof a recording medium on which an image is formed by said recording head, with said conveying belt having a shutter mechanism for closing and opening said opening, said shutter mechanism opening said opening when said opening reaches an area where said recording head opposes said cap.

22. An ink jet recording apparatus, comprising:

a plurality of recording heads each having a discharge port for discharging ink as a droplet;

head recovery means being provided at a position opposite to said discharge port of each recording head, with said head recovery means including cap means provided for covering and receiving ink from each said discharge port and suction means connected to said cap means for collecting ink from each said discharge port to recover operation of said recording heads in association with said cap means; and a conveying belt located between said recording head and said head recovery means and having an opening at a part thereof, with said conveying belt being driven to convey a recording medium on which an image is formed by said recording head, wherein said opening is large enough to permit said recording head to contact said cap means through said opening, said head recovery means being disposed in an area surrounded by said conveying belt, and said recording head and said cap means are relatively movable only in directions opposed to each other whereby said cap means can cover said discharge ports.

23. An ink jet recording apparatus for recording on a recording medium by utilizing recording means having a discharge port for discharging ink therethrough, the apparatus comprising:

a conveying member for conveying the recording medium to a recording position; and discharge recovery and maintaining means including capping means for covering a discharge port forming surface of the recording means and receiving ink from the discharge port and suction means for collecting ink from the discharge port to recover operation of the recording head in association with said capping means, said discharge recovery and maintaining means being provided in a space surrounded by said conveying member, wherein said conveying member has an opening large enough to permit the recording means to contact said capping means, and said capping means and the recording head are relatively movable only in directions opposed to each other whereby said capping means can cover the discharge port.

24. An ink jet recording apparatus according to claim 23, wherein said conveying member includes a flat area and said capping means is provided at a position proximate to said flat area.

* * * * *

UNITED STATES PATENT AND TRADEMARK OFFICE

CERTIFICATE OF CORRECTION

PATENT NO. : 5,040,000

DATED : August 13, 1991

INVENTOR(S) : KATSUYUKI YOKOI

It is certified that error appears in the above-identified patent and that said Letters Patent is hereby corrected as shown below:

COLUMN 2

Line 68, "accompanied" should read --accompanying--.

COLUMN 3

Line 18, "head-can" should read --head can--.

COLUMN 4

Line 17, "step 24" should read --step S24--.
Line 34, "step 21," should read --step S21,--.
Line 46, "applied to" should read --applied--.

COLUMN 6

Line 24, "other" should read --others--.

COLUMN 7

Line 17, "roller 5" should read --rollers 5--.
Line 21, "equation,," should read --equation,--.

COLUMN 8

Line 34, "a" should read --an--.

COLUMN 9

Line 8, "other accordingly" should read --other. Accordingly,--.
Line 64, "head" (second occurrence) should be deleted.

UNITED STATES PATENT AND TRADEMARK OFFICE

CERTIFICATE OF CORRECTION

PATENT NO. : 5,040,000

DATED : August 13, 1991

INVENTOR(S) : KATSUYUKI YOKOI

It is certified that error appears in the above-identified patent and that said Letters Patent is hereby corrected as shown below:

COLUMN 10

Line 28, "recovery operation" should read --said recovery operation--.

COLUMN 11

Line 34, "members" should read --members.--.

Signed and Sealed this

Twenty-third Day of February, 1993

*Attest:*

STEPHEN G. KUNIN

*Attesting Officer*

*Acting Commissioner of Patents and Trademarks*